US009920287B2

(12) United States Patent
Hayama et al.

(10) Patent No.: US 9,920,287 B2
(45) Date of Patent: Mar. 20, 2018

(54) CLEANING COMPOSITION AND CLEANING METHOD

(71) Applicant: JSR Corporation, Minato-ku (JP)

(72) Inventors: Takahiro Hayama, Minato-ku (JP); Megumi Arakawa, Minato-ku (JP); Yuki Kushida, Minato-ku (JP); Kiyotaka Mitsumoto, Minato-ku (JP); Yasutaka Kamei, Minato-ku (JP); Masahiro Noda, Minato-ku (JP); Tatsuya Yamanaka, Minato-ku (JP)

(73) Assignee: JSR CORPORATION, Minato-ku (JP)

( * ) Notice: Subject to any disclaimer, the term of this patent is extended or adjusted under 35 U.S.C. 154(b) by 70 days.

(21) Appl. No.: 14/714,526

(22) Filed: May 18, 2015

(65) Prior Publication Data

US 2015/0337245 A1 Nov. 26, 2015

(30) Foreign Application Priority Data

May 20, 2014 (JP) ..... 2014-104764
Mar. 10, 2015 (JP) ..... 2015-046737

(51) Int. Cl.

| | |
|---|---|
| ***C11D 7/32*** | (2006.01) |
| ***C11D 11/00*** | (2006.01) |
| ***C11D 3/36*** | (2006.01) |
| ***C11D 3/34*** | (2006.01) |
| ***C11D 3/20*** | (2006.01) |
| ***C11D 3/30*** | (2006.01) |

(Continued)

(52) U.S. Cl.

CPC ..... *C11D 11/0047* (2013.01); *C11D 1/37* (2013.01); *C11D 3/2075* (2013.01); *C11D 3/2082* (2013.01); *C11D 3/30* (2013.01); *C11D 3/33* (2013.01); *C11D 3/3409* (2013.01); *C11D 3/36* (2013.01); *C11D 3/361* (2013.01); *C11D 3/3707* (2013.01); *C11D 3/3757* (2013.01); *C11D 7/265* (2013.01); *C11D 7/3209* (2013.01); *C11D 7/3218* (2013.01); *C11D 7/34* (2013.01); *C11D 7/36* (2013.01); *C11D 1/146* (2013.01)

(58) Field of Classification Search

CPC ..... C11D 11/0047
USPC ..... 510/175
See application file for complete search history.

(56) References Cited

U.S. PATENT DOCUMENTS 6,896,744 B2 * 5/2005 Morinaga ..... B08B 3/08 134/2
7,435,712 B2 10/2008 Misra et al.
(Continued)

FOREIGN PATENT DOCUMENTS

| | | |
|---|---|---|
| JP | 2009-055020 | 3/2009 |
| JP | 2009-076716 | 4/2009 |
| JP | 2010-258014 | 11/2010 |

*Primary Examiner* — Gregory E Webb
(74) *Attorney, Agent, or Firm* — Oblon, McClelland, Maier & Neustadt, L.L.P.

(57) ABSTRACT

A cleaning composition includes (A) at least one compound selected from the group consisting of a fatty acid that includes a hydrocarbon group having 8 to 20 carbon atoms, a phosphonic acid that includes a hydrocarbon group having 3 to 20 carbon atoms, a sulfuric acid ester that includes a hydrocarbon group having 3 to 20 carbon atoms, an alkenylsuccinic acid that includes a hydrocarbon group having 3 to 20 carbon atoms, and salts thereof, (B) an organic acid, (C) a water-soluble amine, (D) a water-soluble polymer, and an aqueous medium, the cleaning composition having a pH of 9 or more.

17 Claims, 1 Drawing Sheet

(51) Int. Cl.

| | |
|---|---|
| ***C11D 3/33*** | (2006.01) |
| ***C11D 3/37*** | (2006.01) |
| ***C11D 1/37*** | (2006.01) |
| ***C11D 7/26*** | (2006.01) |
| ***C11D 7/34*** | (2006.01) |
| ***C11D 7/36*** | (2006.01) |
| *C11D 1/14* | (2006.01) |

(56) References Cited

U.S. PATENT DOCUMENTS

| | | | | |
|---|---|---|---|---|
| 7,498,295 | B2 | 3/2009 | Fisher et al. | |
| 9,074,170 | B2 * | 7/2015 | Barnes | C11D 1/72 |
| 9,528,078 | B2 * | 12/2016 | Angst | C11D 3/0084 |
| 2003/0130147 | A1 * | 7/2003 | Koito | C11D 3/0073 510/175 |
| 2003/0130149 | A1 * | 7/2003 | Zhou | C11D 7/3218 510/176 |
| 2003/0144163 | A1 * | 7/2003 | Morinaga | C11D 1/72 510/175 |
| 2004/0038840 | A1 * | 2/2004 | Lee | C11D 3/0073 510/202 |
| 2004/0099290 | A1 * | 5/2004 | Morinaga | B08B 3/08 134/27 |
| 2005/0187326 | A1 * | 8/2005 | Nakazawa | C23C 22/78 524/417 |
| 2009/0239777 | A1 * | 9/2009 | Angst | C11D 3/0084 510/175 |
| 2010/0056410 | A1 * | 3/2010 | Visintin | C11D 1/008 510/176 |
| 2010/0105595 | A1 * | 4/2010 | Lee | C09G 1/02 510/176 |
| 2010/0152086 | A1 * | 6/2010 | Wu | C11D 3/0073 510/175 |
| 2010/0311630 | A1 * | 12/2010 | Mori | C09K 3/1472 510/175 |
| 2011/0076852 | A1 * | 3/2011 | Takahashi | C11D 7/08 438/710 |
| 2012/0042898 | A1 * | 2/2012 | Visintin | C11D 1/008 134/2 |
| 2012/0283163 | A1 * | 11/2012 | Barnes | C11D 1/72 510/175 |
| 2013/0143785 | A1 * | 6/2013 | Taniguchi | C11D 7/3209 510/175 |

* cited by examiner

CLEANING COMPOSITION AND CLEANING METHOD

Japanese Patent Application No. 2014-104764 filed on May 20, 2014, and Japanese Patent Application No. 2015-046737 filed on Mar. 10, 2015, are hereby incorporated by reference in their entirety.

BACKGROUND OF THE INVENTION

The present invention relates to a cleaning composition, and a cleaning method that utilizes the cleaning composition.

Chemical mechanical polishing (CMP) has spread rapidly as a planarization technique used when producing a semiconductor device, for example. CMP is a technique that causes the polishing target and a polishing pad to come in sliding contact with each other while pressing the polishing target against the polishing pad, and supplying a chemical mechanical polishing aqueous dispersion to the polishing pad to chemically and mechanically polish the polishing target.

Along with a recent remarkable increase in the degree of integration of a semiconductor device, even contamination with a trace amount of impurities may significantly affect the performance of the device, and the yield of the product. For example, when an 8-inch wafer has been subjected to CMP, 10,000 or more particles having a particle size of 0.2 micrometers or more are present on the surface of the wafer. It has been desired to remove such particles by cleaning so that only several to several dozen particles remain on the surface of the wafer. The surface concentration of metal impurities (i.e., the number of impurity atoms per square centimeter) is $10^{11}$ to $10^{12}$ or more. It has been desired to remove such metal impurities by cleaning so that the surface concentration of metal impurities is reduced to $1\times10^{10}$ or less. Therefore, a cleaning step that is performed after CMP is indispensable when applying CMP to production of a semiconductor device.

A wiring board included in a semiconductor device includes a wiring material, and a barrier metal material that prevents diffusion of the wiring material into an inorganic material film. Copper or tungsten has been mainly used as the wiring material, and tantalum nitride or titanium nitride has been mainly used as the barrier metal material. For example, when copper and tantalum nitride or titanium nitride are present on the surface of the wiring board, it is necessary to remove a copper oxide film and an organic residue on the surface of the wiring board without causing corrosion of the wiring material and the barrier metal material. Therefore, an acidic cleaning agent that can suppress corrosion of the barrier metal material has been normally used (see JP-A-2010-258014, for example).

The width of a copper wire has been reduced when using a 20 nm node semiconductor substrate, for example, and cobalt that exhibits high adhesion to copper and can form a thin film has been used instead of a known barrier metal material. However, cobalt is easily eluted under acidic conditions, and occurrence of pits due to the acidic solution significantly affects yield when the width of a copper wire is reduced. In recent years, a neutral to alkaline cleaning agent has been used in order to deal with the above problem (see JP-A-2009-055020, for example).

SUMMARY

A known neutral to alkaline cleaning agent is useful for removing a foreign substance and suppressing elution of a metal wire, but cannot sufficiently protect the barrier metal material (particularly a cobalt film) (i.e., corrosion of the barrier metal material may occur). It has been reported that defects may occur on a patterned wafer during cleaning when using a known alkaline cleaning agent.

Several aspects of the invention may solve at least some of the above problems, and provide a cleaning composition that can suppress corrosion of the wiring material and the barrier metal material used for the wiring board, and occurrence of defects, and efficiently remove a metal oxide film and an organic residue on the wiring board, and a cleaning method that utilizes the cleaning composition.

Several aspects of the invention may be implemented as described below (see the following application examples).

APPLICATION EXAMPLE 1

According to a first aspect of the invention, a cleaning composition for cleaning a wiring board includes:

(A) at least one compound selected from the group consisting of a fatty acid that includes a hydrocarbon group having 8 to 20 carbon atoms, a phosphonic acid that includes a hydrocarbon group having 3 to 20 carbon atoms, a sulfuric acid ester that includes a hydrocarbon group having 3 to 20 carbon atoms, an alkenylsuccinic acid that includes a hydrocarbon group having 3 to 20 carbon atoms, and salts thereof;

(B) an organic acid;

(C) a water-soluble amine;

(D) a water-soluble polymer; and an aqueous medium, the cleaning composition having a pH of 9 or more.

APPLICATION EXAMPLE 2

In the cleaning composition according to Application Example 1, the component (B) may be an amino acid.

APPLICATION EXAMPLE 3

In the cleaning composition according to Application Example 2, the amino acid may be at least one amino acid selected from the group consisting of tryptophan, phenylalanine, arginine, and histidine.

APPLICATION EXAMPLE 4

In the cleaning composition according to Application Example 1, the component (C) may be an alkanolamine.

APPLICATION EXAMPLE 5

In the cleaning composition according to Application Example 1, the component (D) may be at least one water-soluble polymer selected from the group consisting of poly(meth) acrylic acid and a polyalkylene glycol.

APPLICATION EXAMPLE 6

In the cleaning composition according to Application Example 1, a cleaning target surface of the wiring board may include a wiring material and a barrier metal material, the wiring material being copper or tungsten, and the barrier metal material being at least one material selected from a group consisting of tantalum, titanium, cobalt, ruthenium, manganese, and compounds thereof.

APPLICATION EXAMPLE 7

In the cleaning composition according to Application Example 6, the cleaning target surface may include a part in which the wiring material and the barrier metal material come in contact with each other.

APPLICATION EXAMPLE 8

In the cleaning composition according to Application Example 1, the absolute value of the difference in corrosion potential between copper and cobalt when immersed in the cleaning composition may be 0.1 V or less.

APPLICATION EXAMPLE 9

According to a second aspect of the invention, a cleaning method includes cleaning a wiring board using the cleaning composition according to any one of Application Examples 1 to 8, the wiring board including a wiring material and a barrier metal material, the wiring material being copper or tungsten, and the barrier metal material being at least one material selected from a group consisting of tantalum, titanium, cobalt, ruthenium, manganese, and compounds thereof.

The cleaning composition can prevent corrosion of the wiring material and the barrier metal material used for the wiring board, and occurrence of defects, and efficiently remove a metal oxide film and an organic residue on the wiring board.

DETAILED DESCRIPTION OF THE EMBODIMENT

Figure 1A:
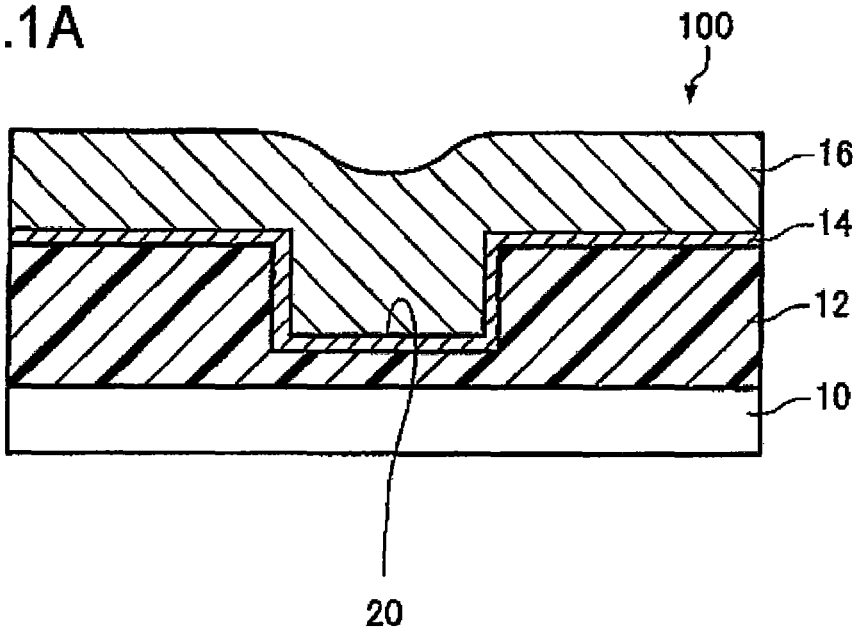
FIGS. 1A and 1B are cross-sectional views schematically illustrating a process that produces a wiring board used in connection with a cleaning method according to one embodiment of the invention.

Several exemplary embodiments of the invention are described in detail below. Note that the invention is not limited to the following exemplary embodiments. Various modifications may be made of the following exemplary embodiments without departing from the scope of the invention.

1. Cleaning Composition

A cleaning composition according to one embodiment of the invention includes (A) at least one compound selected from the group consisting of a fatty acid that includes a hydrocarbon group having 8 to 20 carbon atoms, a phosphonic acid that includes a hydrocarbon group having 3 to 20 carbon atoms, a sulfuric acid ester that includes a hydrocarbon group having 3 to 20 carbon atoms, an alkenylsuccinic acid that includes a hydrocarbon group having 3 to 20 carbon atoms, and salts thereof (hereinafter may be referred to as "component (A)"), (B) an organic acid (hereinafter may be referred to as "component (B)"), (C) a water-soluble amine (hereinafter may be referred to as "component (C)"), (D) a water-soluble polymer (hereinafter may be referred to as "component (D)"), and an aqueous medium, the cleaning composition having a pH of 9 or more. The cleaning composition according to one embodiment of the invention may be mainly used as a cleaning agent for removing particles and metal impurities present on the surface of a wiring material and a barrier metal material after completion of CMP. It is possible to prevent corrosion of the wiring material and the barrier metal material, and occurrence of defects, and efficiently remove an oxide film and an organic residue on the wiring board, by utilizing the cleaning composition according to one embodiment of the invention. The cleaning composition according to one embodiment of the invention exhibits particularly excellent effects when cleaning a wiring board in which copper is used as the wiring material, and cobalt and/or tantalum nitride is used as the barrier metal material. Each component included in the cleaning composition according to one embodiment of the invention is described in detail below.

1.1. Component (A)

The cleaning composition according to one embodiment of the invention includes the component (A) (i.e., at least one compound selected from the group consisting of a fatty acid that includes a hydrocarbon group having 8 to 20 carbon atoms, a phosphonic acid that includes a hydrocarbon group having 3 to 20 carbon atoms, a sulfuric acid ester that includes a hydrocarbon group having 3 to 20 carbon atoms, an alkenylsuccinic acid that includes a hydrocarbon group having 3 to 20 carbon atoms, and salts thereof). The component (C) (i.e., water-soluble amine) included in the cleaning composition according to one embodiment of the invention has an effect of removing (etching) a metal oxide film and an organic residue on the wiring board. However, since a strong etching effect is applied to the barrier metal material, corrosion of the barrier metal material, or defects tend to occur. Since the anionic functional group included in the component (A) is preferentially adsorbed on the surface of the barrier metal material on the wiring board, and the hydrocarbon group included in the component (A) protects the barrier metal material, it is possible to suppress a situation in which the barrier metal material is excessively etched by the component (C). This makes it possible to effectively suppress corrosion of the barrier metal material, and occurrence of defects after completion of CMP.

The component (A) is at least one compound selected from the group consisting of a fatty acid that includes a hydrocarbon group having 8 to 20 carbon atoms, a phosphonic acid that includes a hydrocarbon group having 3 to 20 carbon atoms, a sulfuric acid ester that includes a hydrocarbon group having 3 to 20 carbon atoms, an alkenylsuccinic acid that includes a hydrocarbon group having 3 to 20 carbon atoms, and salts thereof. When the component (A) includes a hydrocarbon group having a number of carbon atoms within the above range, it is possible to suppress corrosion of the barrier metal material while ensuring solubility in the aqueous medium.

Examples of the fatty acid that includes a hydrocarbon group having 8 to 20 carbon atoms include octanoic acid, nonanoic acid, decanoic acid, undecanoic acid, dodecanoic acid, tetradecanoic acid, pentadecanoic acid, hexadecanoic acid, heptadecanoic acid, octadecanoic, and alpha-linolenic acid, linoleic acid, oleic acid, eicosanoic acid, and the like.

Examples of the phosphonic acid that includes a hydrocarbon group having 3 to 20 carbon atoms include propylphosphonic acid, isopropylphosphonic acid, butylphosphonic acid, tert-butylphosphonic acid, hexylphosphonic acid, octylphosphonic acid, decylphosphonic acid, dodecylphosphonic acid, and the like.

Examples of the sulfuric acid ester that includes a hydrocarbon group having 3 to 20 carbon atoms include propyl sulfate, isopropyl sulfate, butyl sulfate, tert-butyl sulfate, hexyl sulfate, octyl sulfate, decyl sulfate, dodecyl sulfate, dodecylbenzene sulfate, and the like.

Examples of the alkenylsuccinic acid that includes a hydrocarbon group having 3 to 20 carbon atoms include a compound represented by the following general formula (1).

(1)

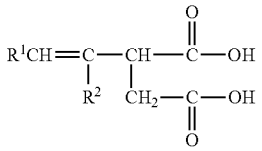

wherein $R^1$ and $R^2$ are a hydrogen atom or a hydrocarbon group having 1 to 17 carbon atoms, provided that one of $R^1$ and $R^2$ is a hydrocarbon group having 1 to 17 carbon atoms.

Examples of the salts of these compounds include sodium salts, potassium salts, ammonium salt, and the like of these compounds.

These compounds may be used either alone or in combination as the component (A).

The content of the component (A) in the cleaning composition is preferably 0.0001 to 1 mass %, more preferably 0.0005 to 0.5 mass %, and particularly preferably 0.001 to 0.1 mass %, based on the total mass of the cleaning composition. When the content of the component (A) is within the above range, it is possible to effectively protect the barrier metal material on the wiring board, and suppress a situation in which the barrier metal material is excessively etched by the component (C). If the content of the component (A) is less than the above range, it may be difficult to suppress a situation in which the wiring material is excessively etched by the component (C). As a result, the cleaning target surface may be corroded, and it may be difficult to obtain a good cleaned surface. If the content of the component (A) exceeds the above range, the wires (wiring area) on the wiring board may be unnecessarily protected, and it may be difficult to efficiently remove a metal oxide film and an organic residue on the wiring board after completion of CMP. As a result, a foreign substance may remain on the wires on the wiring board, and it may be difficult to obtain a good cleaned surface.

1.2. Component (B)

The cleaning composition according to one embodiment of the invention includes the component (B) (i.e., organic acid). It is preferable that the component (B) include one carboxyl group, and further include an amino group, a hydroxyl group, or a carboxyl group. The addition of the component (B) makes it possible to etch the surface of the wiring material (e.g., copper), and remove impurities that adhere to the surface of the wiring material. When a benzotriazole (BTA) layer is formed on the surface of the wiring material by CMP, it is possible to reduce the amount of residual BTA layer by effectively etching a CuO layer, a $Cu_2O$ layer, and a $Cu(OH)_2$ layer that exhibit high affinity to the BTA layer. It is also possible to control the corrosion potential of the wiring material and the barrier metal material on the wiring board, and reduce the difference in corrosion potential between the wiring material and the barrier metal material. This makes it possible to suppress corrosion of each metal due to galvanic corrosion that occurs between dissimilar metals.

The term "galvanic corrosion" used herein refers to corrosion that occurs due to contact between dissimilar metals. The term "galvanic corrosion" normally refers to a phenomenon in which a metal having a lower potential is corroded when metals that differ in potential are brought into contact with each other in an electrolyte solution (e.g., water). In particular, since the wiring material and the barrier metal material come in contact with each other on the wiring board of a semiconductor device, a galvanic action (cell action) occurs when the cleaning agent is present, and the material having a lower inherent potential is selectively corroded. However, the cleaning composition according to one embodiment of the invention that includes the component (B) can reduce the difference in corrosion potential between the wiring material and the barrier metal material. This makes it possible to suppress corrosion of each metal due to galvanic corrosion that occurs between dissimilar metals.

Specific examples of the component (B) include an amino acid such as alanine, arginine, asparagine, aspartic acid, cysteine, glutamine, glutamic acid, glycine, glycylglycine, histidine, isoleucine, leucine, methionine, phenylalanine, proline, serine, threonine, tryptophan, tyrosine, valine, and anthranilic acid, glycolic acid, amidosulfuric acid, formic acid, lactic acid, acetic acid, tartaric acid, oxalic acid, malonic acid, maleic acid, fumaric acid, glutaric acid, phthalic acid, citric acid, malic acid, anthranilic acid, and the like. These organic acids may be used either alone or in combination as the component (B).

It is preferable that the component (B) be at least one organic acid selected from the group consisting of tryptophan, phenylalanine, arginine, and histidine, since the difference in corrosion potential between dissimilar metals can be further reduced. It is preferable that the component (B) be at least one organic acid selected from the group consisting of glycine, glycylglycine, histidine, and serine, from the viewpoint of reducing the amount of residual BTA layer by effectively etching a CuO layer, a $Cu_2O$ layer, and a $Cu(OH)_2$ layer that exhibit high affinity to a BTA layer.

The content of the component (B) in the cleaning composition is preferably 0.0001 to 1 mass %, more preferably 0.0005 to 0.5 mass %, and particularly preferably 0.001 to 0.1 mass %, based on the total mass of the cleaning composition. When the content of the component (B) is within the above range, it is possible to remove impurities that adhere to the surface of the wiring material, and reduce the amount of residual BTA layer by effectively etching a CuO layer, a $Cu_2O$ layer, and a $Cu(OH)_2$ layer that exhibit high affinity to a BTA layer that is formed on the surface of the wiring material by CMP. It is also possible to reduce the difference in corrosion potential between the wiring material and the barrier metal material on the wiring board, and suppress galvanic corrosion of the wiring material and the barrier metal material. If the content of the component (B) falls outside the above range, it may be difficult to reduce the difference in corrosion potential between the wiring material and the barrier metal material on the wiring board. Therefore, galvanic corrosion may occur, and corrosion of the wiring material or the barrier metal material that has a lower potential proceeds.

1.3. Component (C)

The cleaning composition according to one embodiment of the invention includes the component (C) (i.e., water-soluble amine). The component (C) functions as an etchant.

The addition of the component (C) makes it possible to etch and remove a metal oxide film (e.g., CuO layer, $Cu_2O$ layer, and $Cu(OH)_2$ layer) and an organic residue (e.g., BTA layer) on the wiring board in the cleaning step that is performed after CMP.

Note that the term "water-soluble amine" used herein refers to an amine that is dissolved in 100 g water at 20° C. in an amount of 0.1 g or more.

Examples of the component (C) include an alkanolamine, a primary amine, a secondary amine, a tertiary amine, and the like.

Examples of the alkanolamine include monoethanolamine, diethanolamine, triethanolamine, N-methylethanolamine, N-methyl-N,N-diethanolamine, N,N-dimethylethanolamine, N,N-diethylethanolamine, N,N-dibutylethanolamine, N-(beta-aminoethyl)ethanolamine, N-ethylethanolamine, monopropanolamine, dipropanolamine, tripropanolamine, monoisopropanolamine, diisopropanolamine, triisopropanolamine, and the like. Examples of the primary amine include methylamine, ethylamine, propylamine, butylamine, pentylamine, 1,3-propanediamine, and the like. Examples of the secondary amine include piperidine, piperazine, and the like. Examples of the tertiary amine include trimethylamine, triethylamine, and the like. These water-soluble amines may be used either alone or in combination as the component (C).

Among these, monoethanolamine and monoisopropanolamine are preferable, and monoethanolamine is more preferable, since it is possible to effectively etch a metal oxide film and an organic residue on the wiring board.

The content of the component (C) in the cleaning composition is preferably 0.0001 to 1 mass %, more preferably 0.0005 to 0.5 mass %, and particularly preferably 0.001 to 0.1 mass %, based on the total mass of the cleaning composition. When the content of the component (C) is within the above range, it is possible to effectively etch and remove a metal oxide film and an organic residue on the wiring board in the cleaning step that is performed after CMP. If the content of the component (C) is less than the above range, the effect of etching a metal oxide film and an organic residue on the wiring board may be low, and it may be difficult to obtain a good cleaned surface. If the content of the organic acid (C) exceeds the above range, the etching rate of the wiring material and the barrier metal material on the wiring board may increase to a large extent. As a result, the cleaning target surface may be corroded, and it may be difficult to obtain a good cleaned surface.

1.4. Component (D)

The cleaning composition according to one embodiment of the invention includes the component (D) (i.e., water-soluble polymer). The component (D) adheres to the surface of the polishing target surface, and reduces friction due to polishing. Therefore, corrosion of the polishing target surface can be reduced by adding the component (D) to the cleaning composition.

Examples of the component (D) include polyvinyl alcohol, hydroxyethyl cellulose, polyvinylpyrrolidone, poly(meth)acrylic acid, poly(meth)acrylamide, and the like. These water-soluble polymers may be used either alone or in combination as the component (D).

The weight average molecular weight (Mw) of the component (D) is preferably 10,000 to 1,500,000, and more preferably 40,000 to 1,200,000. Note that the term "weight average molecular weight" used herein refers to a polyethylene glycol-equivalent weight average molecular weight determined by gel permeation chromatography (GPC).

The content of the component (D) may be adjusted so that the cleaning composition has a viscosity at room temperature of 2 mPa·s or less. If the viscosity at room temperature of the cleaning composition exceeds 2 mPa·s, it may be difficult to supply the cleaning composition to an abrasive cloth in a stable manner. Since the viscosity of the cleaning composition is substantially determined by the average molecular weight and the content of the component (D), the content of the component (D) may be adjusted taking account of the balance between the average molecular weight and the content of the component (D).

The content of the component (D) in the cleaning composition is preferably 0.0001 to 1 mass %, more preferably 0.0005 to 0.1 mass %, and particularly preferably 0.001 to 0.01 mass %, based on the total mass of the cleaning composition. When the content of the component (D) is within the above range, it is possible to remove particles and metal impurities included in the CMP slurry from the wiring board while suppressing occurrence of corrosion, and obtain a better cleaned surface.

1.5. pH-adjusting Agent

The pH of the cleaning composition according to one embodiment of the invention is 9 or more, preferably 10 to 14, and more preferably 11 to 13. When the pH of the cleaning composition is 9 or more, the protective agent and the etchant (i.e., the components (A) to (D)) easily function on the surface of the wiring board, and it is possible to obtain a good cleaned surface. If the pH of the cleaning composition is less than 9, the etching rate of the barrier metal material (particularly cobalt) tends to increase to a large extent. As a result, the barrier metal material on the wiring board may be corroded, and it may be difficult to obtain a good cleaned surface.

The pH of the cleaning composition according to one embodiment of the invention may be adjusted to 9 or more using an alkali metal hydroxide (e.g., sodium hydroxide, potassium hydroxide, rubidium hydroxide, and cesium hydroxide), an organic ammonium salt (e.g., tetramethylammonium hydroxide), or a basic compound (e.g., ammonia) as a pH-adjusting agent. These pH-adjusting agents may be used either alone or in combination.

Since human health may be impaired by an organic ammonium salt that is normally used for an alkaline cleaning agent, it is preferable to use an alkali metal hydroxide (e.g., sodium hydroxide, potassium hydroxide, rubidium hydroxide, and cesium hydroxide), and more preferably potassium hydroxide.

1.6. Aqueous Medium

The aqueous medium included in the cleaning composition according to one embodiment of the invention is not particularly limited as long as the aqueous medium includes water as the main component, and functions as a solvent. Examples of the aqueous medium include water, a mixed medium of water and an alcohol, a mixed medium of water and a water-miscible organic solvent, and the like. It is preferable to use water or a mixed medium of water and an alcohol. It is more preferable to use water.

Examples of water include ultrapure water, purified water, ion-exchanged water, distilled water, and the like. Among these, ultrapure water, purified water, and ion-exchanged water are preferable, and ultrapure water is more preferable. Note that ultrapure water and purified water may be obtained by passing tap water through activated carbon, and subjecting the resulting water to an ion-exchange treatment and distillation, optionally followed by ultraviolet germicidal irradiation or filtration.

1.7. Additional Component

The cleaning composition according to one embodiment of the invention may further include a nonionic surfactant. The addition of the nonionic surfactant may improve the effect of removing particles and metal impurities included in the CMP slurry from the wiring board, and a better cleaned surface may be obtained.

Examples of the nonionic surfactant include a polyoxyethylene alkyl ether such as polyoxyethylene lauryl ether, polyoxyethylene cetyl ether, polyoxyethylene stearyl ether, and polyoxyethylene oleyl ether; a polyoxyethylene aryl ether such as polyoxyethylene octyl phenyl ether and polyoxyethylene nonyl phenyl ether; a sorbitan fatty acid ester such as sorbitan monolaurate, sorbitan monopalmitate, and sorbitan monostearate; a polyoxyethylene sorbitan fatty acid ester such as polyoxyethylene sorbitan monolaurate, polyoxyethylene sorbitan monopalmitate, and polyoxyethylene sorbitan monostearate; and the like. These nonionic surfactants may be used either alone or in combination.

The content of the nonionic surfactant in the cleaning composition is preferably 0.001 to 1.0 mass %, more preferably 0.002 to 0.1 mass %, and particularly preferably 0.003 to 0.05 mass %, based on the total mass of the cleaning composition. When the content of the nonionic surfactant is within the above range, it may be possible to improve the effect of removing particles and metal impurities included in the CMP slurry from the wiring board, and obtain a better cleaned surface.

1.8. Corrosion Potential

Since the wiring material and the barrier metal material come in contact with each other on the wiring board of a semiconductor device, a galvanic action (cell action) occurs when the cleaning agent is present, and the material having a lower inherent potential is selectively corroded. However, when the cleaning composition according to one embodiment of the invention is present as the cleaning agent, the difference in corrosion potential between the wiring material and the barrier metal material can be reduced due to the function of the component (B), and occurrence of galvanic corrosion can be suppressed.

Metal materials immersed in the cleaning composition according to one embodiment of the invention show an inherent corrosion potential. The cleaning composition according to one embodiment of the invention can reduce the absolute value of the difference in corrosion potential between copper and cobalt to 0.1 V or less, and reduce the absolute value of the difference in corrosion potential between copper and tantalum nitride to 0.3 V or less, due to the function of the component (B). Therefore, the cleaning composition according to one embodiment of the invention can effectively suppress occurrence of galvanic corrosion when cleaning a wiring board in which copper is used as the wiring material, and cobalt and/or tantalum nitride is used as the barrier metal material.

Note that the corrosion potential may be measured as described below, for example. An electrochemical measurement device in which a working electrode (WE) (test sample), a counter electrode (CE) (for causing an electric current to flow), and a reference electrode (RE) are electrically connected to a potentiostat, is provided. The electrodes are immersed in the cleaning composition according to one embodiment of the invention contained in a cell, and a potential is applied using the potentiostat to measure an electric current. A potential-current curve is then measured to determine the corrosion potential.

1.9. Application

The cleaning composition according to one embodiment of the invention may suitably be used when cleaning a wiring board that has been subjected to CMP. It is preferable that the cleaning target surface of the wiring board include a wiring material and a barrier metal material, the wiring material being copper or tungsten, and the barrier metal material being at least one material selected from the group consisting of tantalum, titanium, cobalt, ruthenium, manganese, and compounds thereof. It is possible to effectively prevent corrosion of the wiring material and the barrier metal material, and occurrence of defects, and efficiently remove an oxide film and an organic residue on the wiring board (i.e., the advantageous effects of the invention can be effectively achieved), when cleaning such a wiring board.

The cleaning composition according to one embodiment of the invention can reduce the absolute value of the difference in corrosion potential between copper and cobalt to 0.1 V or less, and reduce the absolute value of the difference in corrosion potential between copper and tantalum nitride to 0.3 V or less. Therefore, it is possible to effectively suppress occurrence of galvanic corrosion (i.e., the advantageous effects of the invention can be most effectively achieved) when cleaning a wiring board in which copper is used as the wiring material, and cobalt and/or tantalum nitride is used as the barrier metal material, and which has a part in which the wiring material and the barrier metal material come in contact with each other.

1.10. Method for Preparing Cleaning Composition

The cleaning composition according to one embodiment of the invention may be prepared using an arbitrary method. For example, the cleaning composition according to one embodiment of the invention may be prepared by adding the component (A), the component (B), the component (C), the component (D), and an optional nonionic surfactant to the aqueous medium, stirring the mixture to dissolve each component in the aqueous medium, and adding the pH-adjusting agent to the solution to adjust the pH of the solution to a predetermined value. The components other than the pH-adjusting agent may be mixed in an arbitrary order using an arbitrary mixing method.

The cleaning composition according to one embodiment of the invention may be prepared as a concentrated solution, and may be diluted with the aqueous medium before use.

2. Cleaning Method

A cleaning method according to one embodiment of the invention includes cleaning a wiring board using the cleaning composition, the wiring board including a wiring material and a barrier metal material, the wiring material being copper or tungsten, and the barrier metal material being at least one material selected from the group consisting of tantalum, titanium, cobalt, ruthenium, manganese, and compounds thereof. A specific example of the cleaning method according to one embodiment of the invention is described in detail below with reference to the drawings.

2.1. Production of Wiring Board

Figure 1B:
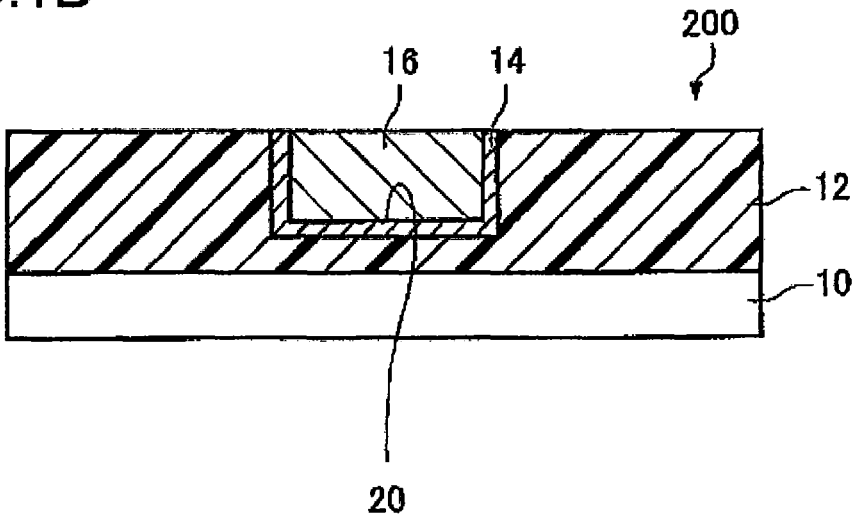

FIGS. 1A and 1B are cross-sectional views schematically illustrating a process that produces the wiring board used in connection with the cleaning method according to one embodiment of the invention. The wiring board is produced as described below.

FIG. 1A is a cross-sectional view schematically illustrating a workpiece that is to be subjected to CMP. As illustrated in FIG. 1A, a workpiece 100 includes a substrate 10. The substrate 10 may include a silicon substrate and a silicon oxide film formed on the silicon substrate, for example. A functional device such as a transistor (not illustrated in FIG. 1A) may be formed on the substrate 10.

The workpiece 100 includes an insulating film 12 that is formed on the substrate 10, a wiring recess 20 being formed in the insulating film 12, a barrier metal film 14 that is formed to cover the surface of the insulating film 12 and the bottom and the inner wall surface of the wiring recess 20, and a metal film 16 that is formed on the barrier metal film 14 so that the wiring recess 20 is filled with the metal film 16, the insulating film 12, the barrier metal film 14, and the metal film 16 being sequentially stacked.

The insulating film 12 may be a silicon oxide film formed by a vacuum process (e.g., a plasma enhanced-TEOS film (PETEOS film), a high-density plasma enhanced-TEOS film (HDP film), or a silicon oxide film obtained by thermal chemical vapor deposition), an insulating film referred to as fluorine-doped silicate glass (FSG), a borophosphosilicate film (BPSG film), an insulating film referred to as silicon oxynitride (SiON), silicon nitride, or the like.

Examples of a metal that forms the barrier metal film 14 include tantalum, titanium, cobalt, ruthenium, manganese, compounds thereof, and the like. The barrier metal film 14 is normally formed of one material among these materials. Note that the barrier metal film 14 may be formed of two or more materials (e.g., tantalum and tantalum nitride) among these materials.

As illustrated in FIG. 1A, the wiring recess 20 must be completely filled with the metal film 16. In order to completely fill the wiring recess 20 with the metal film 16, a metal film having a thickness of 10,000 to 15,000 angstroms is deposited using a chemical vapor deposition method or an electroplating method. Examples of a material for forming the metal film 16 include copper and tungsten. When using copper, pure copperor a copper alloy may be used. The copper content in the copper alloy is preferably 95 mass % or more.

The metal film 16 included in the workpiece 100 illustrated in FIG. 1A is subjected to CMP (polished) at a high speed in an area other than the area situated within the wiring recess 20 until the barrier metal film 14 is exposed (first polishing step). The exposed barrier metal film 14 is then subjected to CMP (polished) (second polishing step). A wiring board 200 illustrated in FIG. 1B is thus obtained.

2.2. Cleaning Step

The surface (cleaning target surface) of the wiring board 200 illustrated in FIG. 1B is then cleaned using the cleaning composition. The cleaning method according to one embodiment of the invention can prevent corrosion of the wiring material and the barrier metal material, and efficiently remove an oxide film and an organic residue on the wiring board when cleaning the wiring board which has been subjected to CMP and on which the wiring material and the barrier metal material are present. Since the cleaning method according to one embodiment of the invention utilizes the cleaning composition that can reduce the difference in corrosion potential between copper and cobalt and the difference in corrosion potential between copper and tantalum nitride, the cleaning method according to one embodiment of the invention achieves particularly excellent effects when cleaning a wiring board in which copper is used as the wiring material, and cobalt and/or tantalum nitride is used as the barrier metal material.

The cleaning method is not particularly limited. For example, the cleaning method is implemented by bringing the cleaning composition into direct contact with the wiring board 200. The cleaning composition may be brought into direct contact with the wiring board 200 using a dipping method that fills a cleaning tank with the cleaning composition, and immerses the wiring board in the cleaning composition; a spin method that rotates the wiring board at a high speed while supplying the cleaning composition to the wiring board from a nozzle; a spray method that sprays the cleaning composition onto the wiring board; or the like. Examples of a device used to implement such a method include a batch-type cleaning device that simultaneously cleans a plurality of wiring boards placed in a cassette, a single-wafer cleaning device that cleans a single wiring board held by a holder, and the like.

When implementing the cleaning method according to one embodiment of the invention, the cleaning composition is normally used at room temperature. Note that the cleaning composition may be heated as long as the performance of the cleaning composition is not impaired. For example, the cleaning composition may be heated to about 40 to 70° C.

It is also preferable to use a cleaning method that utilizes physical force in combination with the method that brings the cleaning composition into direct contact with the wiring board 200. This makes it possible to more effectively remove contamination due to particles that adhere to the wiring board 200, and reduce the cleaning time. Examples of the cleaning method that utilizes physical force include a scrubbing method that utilizes a cleaning brush, and an ultrasonic cleaning method.

A cleaning step using ultrapure water or purified water may be performed before and/or after the cleaning step that utilizes the cleaning method according to one embodiment of the invention.

3. Examples

The invention is further described below by way of examples. Note that the invention is not limited to the following examples. Note that the units "parts" and "%" used in the examples respectively refer to "parts by mass" and "mass %" unless otherwise indicated.

3.1. Preparation of Cleaning Composition

A container made of polyethylene was charged with the components (other than potassium hydroxide) shown in Table 1 or 2 and ion-exchanged water, and the mixture was stirred for 15 minutes. After the addition of ion-exchanged water to the mixture so that the total amount of the components was 100 parts by mass, the pH of the mixture was adjusted to the value shown in Table 1 or 2 using potassium hydroxide. The mixture was then filtered through a filter having a pore size of 5 micrometers to obtain the cleaning composition shown in Table 1 or 2. The pH of the mixture was measured using a pH meter "F52" (manufactured by Horiba Ltd.).

3.2. Evaluation of Etching Rate (ER)

The etching rate of copper and cobalt was determined as follows. A silicon wafer (diameter: 8 inches) on which a film of each material was formed was immersed in the cleaning composition (temperature: 25° C.), and the etching rate was calculated from a change in thickness due to immersion. The etching rate was evaluated in accordance with the following standard. The etching rate and the evaluation results are shown in Tables 1 and 2.

<Etching Rate of Copper>

A case where the etching rate of copper was 0.1 to 1.0 angstroms/min was evaluated as "Good", since the etching rate of copper is moderate, and unnecessary copper oxide film can be removed by cleaning.

A case where the etching rate of copper was higher than 1.0 angstrom/min was evaluated as "Bad", since the etching rate of copper is too high.

A case where the etching rate of copper was less than 0.1 angstroms/min was evaluated as "Bad", since the etching rate of copper is too low, and a copper oxide film cannot be removed by cleaning.

<Etching Rate of Cobalt>

A case where the etching rate of cobalt was 0.8 angstroms/min or less was evaluated as "Good", since etching of cobalt can be sufficiently suppressed.

A case where the etching rate of cobalt was higher than 0.8 angstroms/min was evaluated as "Bad", since the etching rate of cobalt is too high.

3.3. Evaluation of Corrosion of Copper

The surface of a copper film formed on a silicon wafer for which the etching rate has been evaluated, was observed using an optical microscope to evaluate corrosion of copper. Corrosion of copper was evaluated in accordance with the following standard. The results are shown in Tables 1 and 2.

A case where the number of dots over the entire surface of the substrate (diameter: 8 inches) was 20 or less, and no cloud was observed with the naked eye, was evaluated as "Good".

A case where the number of dots over the entire surface of the substrate (diameter: 8 inches) was more than 20, and a cloud was observed with the naked eye, was evaluated as "Bad".

3.4. Evaluation of Corrosion of Cobalt

The surface of a cobalt film formed on a silicon wafer for which the etching rate has been evaluated, was observed with respect to the number of dots using an optical microscope to evaluate corrosion of cobalt. Corrosion of cobalt was evaluated in accordance with the following standard. The results are shown in Tables 1 and 2.

A case where the number of dots over the entire surface of the substrate (diameter: 8 inches) was 50 or less was evaluated as "Good".

A case where the number of dots over the entire surface of the substrate (diameter: 8 inches) was more than 50 was evaluated as "Bad".

3.5. Measurement of Difference in Corrosion Potential

An electrochemical measurement device in which a working electrode (WE) (test sample), a counter electrode (CE) (for causing an electric current to flow), and a reference electrode (RE) were electrically connected to a potentiostat, was provided. Copper, cobalt, and tantalum nitride were used as the test sample. The electrodes were immersed in the cleaning composition contained in a cell, and a potential was applied using the potentiostat to measure an electric current. A potential-current curve was then measured to determine the corrosion potential (V) of each sample. The absolute value (V) of the difference in corrosion potential between copper and cobalt, and the absolute value (V) of the difference in corrosion potential between copper and tantalum nitride were calculated from the corrosion potential of each sample. The difference in corrosion potential was evaluated in accordance with the following standard. The absolute value of the difference in corrosion potential and the evaluation results are shown in Tables 1 and 2.

<Absolute Value (V) of Difference in Corrosion Potential Between Copper and Cobalt>

A case where the absolute value of the difference in corrosion potential between copper and cobalt was 0.1 V or less was evaluated as "Good", since it is considered that occurrence of galvanic corrosion can be suppressed when cleaning a wiring board in which copper is used as the wiring material, and cobalt is used as the barrier metal material.

A case where the absolute value of the difference in corrosion potential between copper and cobalt was more than 0.1 V was evaluated as "Bad", since it is considered that occurrence of galvanic corrosion cannot be suppressed when cleaning a wiring board in which copper is used as the wiring material, and cobalt is used as the barrier metal material.

3.6. Wiring Board Cleaning Test 3.6.1. Chemical Mechanical Polishing

A substrate provided with a copper wire pattern (i.e., a test substrate obtained by depositing a PETEOS film (thickness: 5000 angstroms) on a silicon substrate, forming a pattern using a mask ("SEMATECH 854"), and sequentially depositing a cobalt film (thickness: 250 angstroms), a copper seed film (thickness: 1000 angstroms), and a copper plating film (thickness: 10,000 angstroms) thereon) (hereinafter may be referred to as "SEMATECH 854") was subjected to two-step chemical mechanical polishing under the following conditions using a chemical mechanical polishing device "EPO112" (manufactured by EBARA Corporation).

<First-step Chemical Mechanical Polishing>

Chemical mechanical polishing aqueous dispersion: "CMS7501/CMS7552" manufactured by JSR Corporation Polishing pad: "IC1000/SUBA400" manufactured by Rodel Nitta Platen rotational speed: 70 rpm Head rotational speed: 70 rpm Head load: 50 g/cm$^2$ Chemical mechanical polishing aqueous dispersion supply rate: 200 mL/min Polishing time: 150 sec <Second-step Chemical Mechanical Polishing>

Chemical mechanical polishing aqueous dispersion: "CMS8501/CMS8552" manufactured by JSR Corporation Polishing pad: "IC1000/SUBA400" manufactured by Rodel Nitta Platen rotational speed: 70 rpm Head rotational speed: 70 rpm Head load: 250 g/cm$^2$ Chemical mechanical polishing aqueous dispersion supply rate: 200 mL/min Polishing time: 60 seconds 3.6.2. Cleaning The surface of the substrate subjected to chemical mechanical polishing was cleaned on the platen under the following conditions, and then subjected to brush scrub cleaning under the following conditions.

<Cleaning on Platen>

Cleaning agent: cleaning composition prepared as described above

Head rotational speed: 70 rpm

Head load: 100 gf/cm$^2$

Platen rotational speed: 70 rpm

Cleaning agent supply rate: 300 mL/min

Cleaning time: 30 sec

<Brush Scrub Cleaning>

Cleaning agent: cleaning composition prepared as described above

Upper brush rotational speed: 100 rpm

Lower brush rotational speed: 100 rpm

Substrate rotational speed: 100 rpm

Cleaning agent supply rate: 300 mL/min

Cleaning time: 30 sec 3.6.3. Evaluation of Defects

The number of defects over the entire polishing target surface of the cleaned substrate was measured using a wafer defect inspection device ("KLA2351" manufactured by KLA-Tencor). A case where the number of defects is 200 or less was evaluated as acceptable.

3.7. Evaluation Results

Tables 1 and 2 show the composition of the cleaning composition and the evaluation results.

TABLE 1

| | | Example | | | | | | |
|---|---|---|---|---|---|---|---|---|
| | | 1 | 2 | 3 | 4 | 5 | 6 | 7 |
| Component (A) | Alkenylsuccinic acid | 0.001 | 0.1 | | | | | |
| | Lauryl sulfate | | | 0.1 | 0.1 | | | |
| | Lauric acid | | | | | 0.1 | 0.1 | 0.1 |
| Component other than component (A) | 1,4-Diethyl sulfosuccinate | | | | | | | |
| | Butanoic acid | | | | | | | |
| Component (B) | Tryptophan | | | 0.003 | | | | |
| | Phenylalanine | | | | 0.003 | | | |
| | Histidine | 0.003 | 0.003 | | | | | |
| | Arginine | | | | | 0.003 | | |
| | Malonic acid | | | | | | 0.003 | |
| | Glycolic acid | | | | | | | 0.003 |
| Component (C) | Monoethanolamine | 0.03 | 0.03 | 0.02 | 0.02 | 0.03 | 0.02 | 0.02 |
| | Monoisopropanolamine | | | | | | | |
| | Diisopropanolamine | | | | | | | |
| | Triisopropanolamine | | | | | | | |
| Component (D) | Polyacrylic acid | 0.002 | 0.002 | 0.001 | | | | |
| | Polyethylene glycol | | | | 0.002 | 0.001 | 0.002 | 0.001 |
| pH-adjusting agent | Potassium hydroxide | Good | Good | Good | Good | Good | Good | Good |
| | pH | 11 | 11.7 | 11 | 11.7 | 11 | 11.7 | 11 |
| Evaluation item | Copper etching rate (angstroms/min) | 0.6 | 0.6 | 0.5 | 0.5 | 0.6 | 0.5 | 0.5 |
| | Evaluation of copper etching rate | Good | Good | Good | Good | Good | Good | Good |
| | Cobalt etching rate (angstroms/min) | 0.1 | 0.1 | 0.1 | 0.1 | 0.1 | 0.1 | 0.1 |
| | Evaluation of cobalt etching rate | Good | Good | Good | Good | Good | Good | Good |
| | Absolute value (V) of difference in corrosion potential between copper and cobalt | 0 | 0.07 | 0.02 | 0.04 | 0 | 0.04 | 0.03 |
| | Evaluation of difference in corrosion potential between copper and cobalt | Good | Good | Good | Good | Good | Good | Good |
| | Corrosion of copper | Good | Good | Good | Good | Good | Good | Good |
| | Corrosion of cobalt (number of dots) | 21 | 35 | 19 | 17 | 18 | 15 | 17 |
| | Evaluation of defects (number of defects) | 52 | 91 | 112 | 105 | 130 | 87 | 124 |

| | | Example | | | | | | |
|---|---|---|---|---|---|---|---|---|
| | | 8 | 9 | 10 | 11 | 12 | 13 | 14 |
| Component (A) | Alkenylsuccinic acid | 0.001 | 0.001 | 0.001 | | 0.001 | 0.001 | 0.001 |
| | Lauryl sulfate | | | | 0.1 | | | |
| | Lauric acid | | | | | | | |
| Component other than component (A) | 1,4-Diethyl sulfosuccinate | | | | | | | |
| | Butanoic acid | | | | | | | |
| Component (B) | Tryptophan | | | | | | | |
| | Phenylalanine | | | | | | | |
| | Histidine | 0.003 | 0.003 | 0.003 | 0.003 | 0.003 | 0.003 | 0.003 |
| | Arginine | | | | | | | |
| | Malonic acid | | | | | | | |
| | Glycolic acid | | | | | | | |
| Component (C) | Monoethanolamine | 0.03 | 0.03 | 0.03 | 0.03 | 0.03 | 0.03 | 0.03 |
| | Monoisopropanolamine | 0.01 | | | | | | |
| | Diisopropanolamine | | 0.01 | | | | | |
| | Triisopropanolamine | | | 0.01 | 0.01 | | | |
| Component (D) | Polyacrylic acid | 0.002 | 0.002 | 0.002 | | 0.002 | 0.002 | 0.0005 |
| | Polyethylene glycol | | | | 0.002 | | | |
| pH-adjusting agent | Potassium hydroxide | Good | Good | Good | Good | Good | Good | Good |
| | pH | 11 | 11 | 11 | 11.7 | 10 | 9.2 | 11 |
| Evaluation item | Copper etching rate (angstroms/min) | 0.6 | 0.6 | 0.6 | 0.6 | 0.6 | 0.6 | 0.6 |
| | Evaluation of copper etching rate | Good | Good | Good | Good | Good | Good | Good |
| | Cobalt etching rate (angstroms/min) | 0.1 | 0.1 | 0.1 | 0.1 | 0.1 | 0.1 | 0.1 |
| | Evaluation of cobalt etching rate | Good | Good | Good | Good | Good | Good | Good |
| | Absolute value (V) of difference in corrosion potential between copper and cobalt | 0.02 | 0.01 | 0.01 | 0.03 | 0 | 0 | 0 |
| | Evaluation of difference in corrosion potential between copper and cobalt | Good | Good | Good | Good | Good | Good | Good |

TABLE 1-continued

| | | | | | | | | |
|---|---|---|---|---|---|---|---|---|
| | Corrosion of copper | Good | Good | Good | Good | Good | Good | Good |
| | Corrosion of cobalt (number of dots) | 19 | 20 | 16 | 18 | 11 | 14 | 18 |
| | Evaluation of defects (number of defects) | 47 | 61 | 43 | 95 | 46 | 67 | 91 |

TABLE 2

| | | Comparative Example | | | | | | | |
|---|---|---|---|---|---|---|---|---|---|
| | | 1 | 2 | 3 | 4 | 5 | 6 | 7 | 8 |
| Component (A) | Alkenylsuccinic acid | | 0.01 | | 0.01 | | 0.01 | | |
| | Lauryl sulfate | | | | | | | 0.01 | |
| | Lauric acid | | | 0.01 | | | | | |
| Component other than component (A) | 1,4-Diethyl sulfosuccinate | | | | | | | | 0.01 |
| | Butanoic acid | | | | | 0.01 | | | |
| Component (B) | Tryptophan | | | | | 0.003 | 0.003 | | |
| | Phenylalanine | | | | 0.003 | | | | |
| | Histidine | | 0.003 | | | | | 0.003 | 0.003 |
| | Arginine | 0.003 | | | | | | | |
| | Malonic acid | | | | | | | | |
| | Glycolic acid | | | | | | | | |
| Component (C) | Monoethanolamine | 0.03 | 0.03 | 0.03 | | 0.03 | 0.03 | 0.03 | 0.03 |
| | Monoisopropanolamine | | | | | | | | |
| | Diisopropanolamine | | | | | | | | |
| | Triisopropanolamine | | | | | | | | |
| Component (D) | Polyacrylic acid | 0.002 | | 0.002 | 0.002 | 0.002 | 0.002 | 0.002 | 0.002 |
| | Polyethylene glycol | | | | | | | | |
| pH-adjusting agent | Potassium hydroxide | Good | Good | Good | Good | Good | Good | Good | Good |
| | pH | 11 | 11 | 11 | 11 | 11 | 8.5 | 7.5 | 11 |
| Evaluation item | Copper etching rate (angstroms/min) | 0.6 | 0.6 | 0.6 | <0.1 | 0.6 | 0.6 | 0.6 | 0.6 |
| | Evaluation of copper etching rate | Good | Good | Good | Bad | Good | Good | Good | Good |
| | Cobalt etching rate (angstroms/min) | 1.2 | 0.1 | 0.3 | 0.1 | 1 | 0.1 | 0.1 | 1 |
| | Evaluation of cobalt etching rate | Bad | Good | Good | Good | Bad | Good | Good | Bad |
| | Absolute value (V) of difference in corrosion potential between copper and cobalt | 0 | 0 | 0 | 0 | 0 | 0.3 | 0 | 0.05 |
| | Evaluation of difference in corrosion potential between copper and cobalt | Good | Good | Good | Good | Good | Bad | Good | Good |
| | Corrosion of copper | Good | Good | Bad | Good | Good | Good | Good | Good |
| | Corrosion of cobalt (number of dots) | 295 | 8 | 21 | 12 | 155 | 17 | >500 | >500 |
| | Evaluation of defects (number of defects) | 55 | >1000 | 123 | 41 | 63 | 77 | 51 | 60 |

The details of some components shown in Tables 1 and 2 are shown below.

Alkenylsuccinic acid ("DSA" manufactured by Sanyo Chemical Industries Ltd., succinic anhydride that includes an alkenyl group having 12 carbon atoms)

Polyacrylic acid ("JURYMER AC-103" manufactured by Toagosei Co., Ltd., aqueous solution, weight average molecular weight (Mw): 6000)

Polyethylene glycol ("PEG #200" manufactured by NOF Corporation, weight average molecular weight (Mw): 200)

As is clear from the results shown in Tables 1 and 2, the etching rate of copper, the etching rate of cobalt, the absolute value of the difference in corrosion potential between copper and cobalt, the absolute value of the difference in corrosion potential between copper and tantalum nitride, and the corrosion state of the surface of copper observed using an optical microscope were within the preferable ranges when using the cleaning compositions of Examples 1 to 14, and the cleaning target surface could be effectively cleaned without causing corrosion of the wiring material and the barrier metal material.

The invention is not limited to the above embodiments. Various modifications and variations may be made of the above embodiments. For example, the invention includes various other configurations substantially the same as the configurations described in connection with the above embodiments (e.g., a configuration having the same function, method, and results, or a configuration having the same objective and results). The invention also includes a configuration in which an unsubstantial element described in connection with the above embodiments is replaced by another element. The invention also includes a configuration having the same effects as those of the configurations described in connection with the above embodiments, or a configuration capable of achieving the same objective as that of the configurations described in connection with the above embodiments. The invention further includes a configuration in which a known technique is added to the configurations described in connection with the above embodiments.

Although only some embodiments of the invention have been described in detail above, those skilled in the art would readily appreciate that many modifications are possible in the embodiments without materially departing from the novel teachings and advantages of the invention. Accordingly, all such modifications are intended to be included within the scope of the invention.

What is claimed is:

1. A cleaning composition comprising:

(A) at least one compound selected from the group consisting of a fatty acid that includes a hydrocarbon group having 8 to 20 carbon atoms, an alkenylsuccinic acid that includes a hydrocarbon group having 3 to 20 carbon atoms, and salts thereof;

(B) an organic acid;

(C) a water-soluble amine;

(D) a water-soluble polymer; and an aqueous medium, the cleaning composition having a pH of 9.2 or more, wherein a content of component (A) in the cleaning composition is 0.0001 to 0.1 mass %, based on a total mass of the cleaning composition, wherein a content of component (B) in the cleaning composition is 0.0001 to 0.1 mass %, based on a total mass of the cleaning composition, wherein a content of component (C) in the cleaning composition is 0.0001 to 0.1 mass %, based on a total mass of the cleaning composition, wherein a content of component (D) in the cleaning composition is 0.0001 to 1 mass %, based on a total mass of the cleaning composition, and wherein the cleaning composition is suitable for cleaning a wiring board.

2. The cleaning composition according to claim 1, wherein the component (B) is an amino acid.

3. The cleaning composition according to claim 2, wherein the amino acid is at least one amino acid selected from the group consisting of tryptophan, phenylalanine, arginine, and histidine.

4. The cleaning composition according to claim 1, wherein the component (C) is an alkanolamine.

5. The cleaning composition according to claim 1, wherein the component (D) is at least one water-soluble polymer selected from the group consisting of poly (meth)acrylic acid and a polyalkylene glycol.

6. The cleaning composition according to claim 1, wherein a cleaning target surface of the wiring board includes a wiring material and a barrier metal material, the wiring material being copper or tungsten, and the barrier metal material being at least one material selected from the group consisting of tantalum, titanium, cobalt, ruthenium, manganese, and compounds thereof.

7. The cleaning composition according to claim 6, wherein the cleaning target surface includes a part in which the wiring material and the barrier metal material come in contact with each other.

8. The cleaning composition according to claim 1, wherein an absolute value of a difference in corrosion potential between copper and cobalt when immersed in the cleaning composition is 0.1 V or less.

9. A cleaning method comprising contacting a wiring board with the cleaning composition according to claim 1, the wiring board including a wiring material and a barrier metal material, the wiring material being copper or tungsten, and the barrier metal material being at least one material selected from the group consisting of tantalum, titanium, cobalt, ruthenium, manganese, and compounds thereof.

10. The cleaning composition according to claim 1, wherein the component (A) comprises a fatty acid that includes a hydrocarbon group haying 8 to 20 carbon atoms, or a salt thereof.

11. The cleaning composition according to claim 1, wherein the component (A) comprises an alkenylsuccinic acid that includes a hydrocarbon group haying 3 to 20 carbon atoms, or a salt thereof.

12. The cleaning composition according to claim 2, wherein the amino acid comprises tryptophan.

13. The cleaning composition according to claim 2, wherein the amino acid comprises phenylalanine.

14. The cleaning composition according to claim 2, wherein the amino acid comprises arginine.

15. The cleaning composition according to claim 2, wherein the amino acid comprises histidine.

16. The cleaning composition according to claim 1, wherein the component (D) comprises poly(meth)acrylic acid.

17. The cleaning composition according to claim 1, wherein the component (D) comprises a polyalkylene glycol.

* * * * *